US008302689B2

(12) United States Patent
van Zuilekom et al.

(10) Patent No.: US 8,302,689 B2
(45) Date of Patent: Nov. 6, 2012

(54) APPARATUS AND METHOD FOR MANIPULATING FLUID DURING DRILLING OR PUMPING OPERATIONS

(75) Inventors: Anthony H. van Zuilekom, Houston, TX (US); Gregory N Gilbert, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 539 days.

(21) Appl. No.: 12/445,002

(22) PCT Filed: Oct. 11, 2006

(86) PCT No.: PCT/US2006/039765

§ 371 (c)(1),
(2), (4) Date: Feb. 8, 2010

(87) PCT Pub. No.: WO2008/045045

PCT Pub. Date: Apr. 17, 2008

(65) Prior Publication Data

US 2010/0132941 A1 Jun. 3, 2010

(51) Int. Cl.
*E21B 49/08* (2006.01)

(52) U.S. Cl. ..... 166/264; 166/250.07; 166/68

(58) Field of Classification Search ..... 166/369, 166/264, 250.07, 68, 105
See application file for complete search history.

(56) References Cited

U.S. PATENT DOCUMENTS

| | | | | |
|---|---|---|---|---|
| 5,799,733 | A | 9/1998 | Ringgenberg et al. | |
| 6,334,489 | B1 | 1/2002 | Shwe et al. | |
| 2001/0050170 | A1 | 12/2001 | Woie et al. | |
| 2003/0139916 | A1 * | 7/2003 | Choe et al. | 703/10 |
| 2005/0161218 | A1 | 7/2005 | van Zuilekom et al. | |
| 2005/0235745 | A1 | 10/2005 | Proett et al. | |
| 2005/0257611 | A1 | 11/2005 | Fogal et al. | |
| 2005/0257960 | A1 | 11/2005 | McGregor et al. | |
| 2005/0268709 | A1 | 12/2005 | McGregor et al. | |

FOREIGN PATENT DOCUMENTS

| | | | |
|---|---|---|---|
| GB | 2345137 | A | 6/2000 |
| WO | WO-02/20944 | A1 | 3/2002 |
| WO | WO-2008/045045 | A1 | 4/2008 |

OTHER PUBLICATIONS

"International Application Serial No. PCT/US2006/039765, International Search Report mailed Jun. 20, 2007", 5 pgs.
"International Application Serial No. PCT/US2006/039765, Written Opinion mailed Jun. 20, 2007", 6 pgs.

* cited by examiner

*Primary Examiner* — William P Neuder
(74) *Attorney, Agent, or Firm* — Schwegman Lundberg & Woessner, P.A.

(57) ABSTRACT

A method and apparatus for manipulating fluid, such as measuring bubble point, during drilling or pumping operations including pumping fluid in a borehole through a flow line (200) and drawing fluid from the flow line through an isolation line (232) without substantially dropping pressure of the flow line or without ceasing pumping operations.

21 Claims, 11 Drawing Sheets

APPARATUS AND METHOD FOR MANIPULATING FLUID DURING DRILLING OR PUMPING OPERATIONS

RELATED APPLICATIONS

This application is a U.S. National Stage Filing under 35 U.S.C. 371 from International Application Number PCT/US2006/039765, filed Oct. 11, 2006 and published in English as WO 2008/045045 on Apr. 17, 2008, which application and publication are incorporated herein by reference in their entirety.

FIELD

The subject matter relates to formation testing, and more particularly, to manipulation of fluid during drilling or pumping operations.

BACKGROUND

In drilling a wellbore, drilling fluid is used to facilitate the drilling process and to maintain a hydrostatic pressure in the wellbore greater than the pressure in the formations surrounding the wellbore. The drilling fluid penetrates into or invades the formations depending upon the types of the formation and drilling fluid used. The formation testing tools retrieve formation fluids from the desired formations or zones of interest, test the retrieved fluids to ensure that the retrieved fluid is substantially free of filtrates. The testing tools further collect fluids, for example, in one or more chambers associated with the tool. The collected fluids are brought to the surface and analyzed to determine properties of such fluids and to determine the conditions of the zones or formations from where such fluids have been collected. In order to properly analyze the samples, it is important that only uncontaminated fluids are collected in the same condition in which they exist in the formation. For example, the fluid is maintained in a single phase, which is done by maintaining the pressure of the fluid constantly above the bubble point.

Conventional formation tester tools may need to manipulate the sample fluid to make fluid property measurements such as the bubble point by periodically measuring the static bubble point. This requires the pumping operation to cease during the fluid measurement, allowing contamination to encroach into the sample zone, and further slowing the overall pumping process.

Accordingly, what is needed is a testing operation or pumping operation that does not require the pumping operation to cease while testing the fluid.

DESCRIPTION

Figure 1:
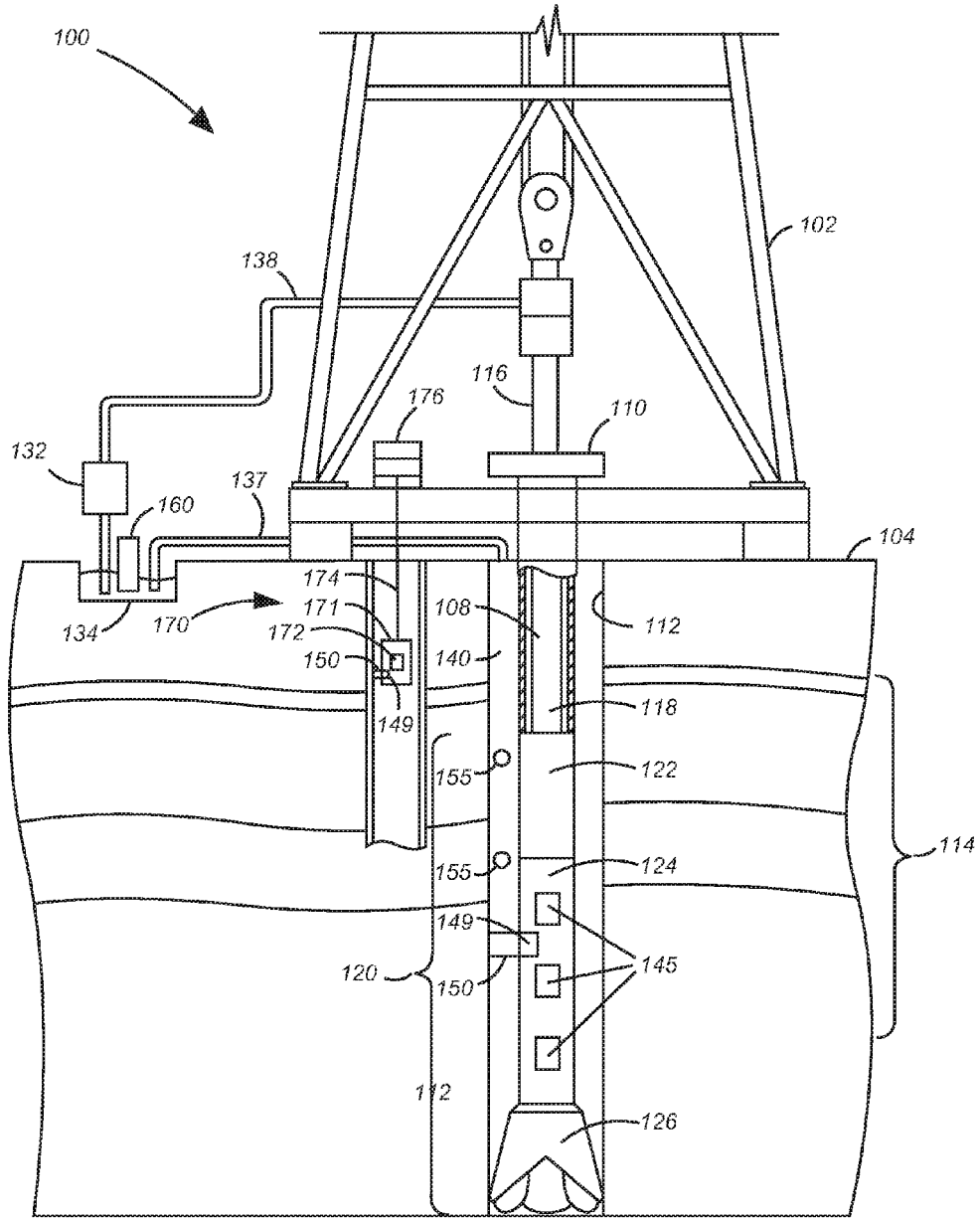
FIG. 1 illustrates a system for drilling operations as constructed in accordance with at least one embodiment.

In the following description of some embodiments of the present invention, reference is made to the accompanying drawings which form a part hereof, and in which are shown, by way of illustration, specific embodiments of the present invention which may be practiced. In the drawings, like numerals describe substantially similar components throughout the several views. These embodiments are described in sufficient detail to enable those skilled in the art to practice the present invention. Other embodiments may be utilized and structural, logical, and electrical changes may be made without departing from the scope of the present invention. The following detailed description is not to be taken in a limiting sense, and the scope of the present invention is defined only by the appended claims, along with the full scope of equivalents to which such claims are entitled.

FIG. 1 illustrates a system 100 for drilling operations. It should be noted that the system 100 can also include a system for pumping operations, or other operations. The system 100 includes a drilling rig 102 located at a surface 104 of a well. The drilling rig 102 provides support for a down hole apparatus, including a drill string 108. The drill string 108 penetrates a rotary table 110 for drilling a borehole 112 through subsurface formations 114. The drill string 108 includes a Kelly 116 (in the upper portion), a drill pipe 118 and a bottom hole assembly 120 (located at the lower portion of the drill pipe 118). The bottom hole assembly 120 may include drill collars 122, a downhole tool 124 and a drill bit 126. The downhole tool 124 may be any of a number of different types of tools including measurement-while-drilling (MWD) tools, logging-while-drilling (LWD) tools, etc.

During drilling operations, the drill string 108 (including the Kelly 116, the drill pipe 118 and the bottom hole assembly 120) may be rotated by the rotary table 110. In addition or alternative to such rotation, the bottom hole assembly 120 may also be rotated by a motor that is downhole. The drill collars 122 may be used to add weight to the drill bit 126. The drill collars 122 also optionally stiffen the bottom hole assembly 120 allowing the bottom hole assembly 120 to transfer the weight to the drill bit 126. The weight provided by the drill collars 122 also assists the drill bit 126 in the penetration of the surface 104 and the subsurface formations 114.

During drilling operations, a mud pump 132 optionally pumps drilling fluid, for example, drilling mud, from a mud pit 134 through a hose 136 into the drill pipe 118 down to the drill bit 126. The drilling fluid can flow out from the drill bit 126 and return back to the surface through an annular area 140 between the drill pipe 118 and the sides of the borehole 112. The drilling fluid may then be returned to the mud pit 134, for example via pipe 137, and the fluid is filtered. The drilling fluid cools the drill bit 126 as well as provides for lubrication of the drill bit 126 during the drilling operation. Additionally, the drilling fluid removes the cuttings of the subsurface formations 114 created by the drill bit 126.

The downhole tool 124 may include one to a number of different sensors 145, which monitor different downhole parameters and generate data that is stored within one or more different storage mediums within the downhole tool 124. The type of downhole tool 124 and the type of sensors 145 thereon may be dependent on the type of downhole parameters being measured. Such parameters may include the downhole temperature and pressure, the various characteristics of the subsurface formations (such as resistivity, radiation, density, porosity, etc.), the characteristics of the borehole (e.g., size, shape, etc.), etc.

The downhole tool 124 further includes a power source 149, such as a battery or generator. A generator could be powered either hydraulically or by the rotary power of the drill string. The downhole tool 124 includes a formation testing tool 150, which can be powered by power source 149. In an embodiment, the formation testing tool 150 is mounted on a drill collar 122. The formation testing tool 150 engages the wall of the borehole 112 and extracts a sample of the fluid in the adjacent formation via a flow line. As will be described later in greater detail, the formation testing tool 150 samples the formation and inserts a fluid sample in a sample carrier 155. The tool 150 injects the carrier 155 into the return mud stream that is flowing intermediate the borehole wall 112 and the drill string 108, shown as drill collars 122 in FIG. 1. The sample carrier(s) 155 flow in the return mud stream to the surface and to mud pit or reservoir 134. A carrier extraction unit 160 is provided in the reservoir 134, in an embodiment. The carrier extraction unit 160 removes the carrier(s) 155 from the drilling mud.

FIG. 1 further illustrates an embodiment of a wireline system 170 that includes a downhole tool body 171 coupled to a base 176 by a logging cable 174. The logging cable 174 may include, but is not limited to, a wireline (multiple power and communication lines), a mono-cable (a single conductor), and a slick-line (no conductors for power or communications). The base 176 is positioned above ground and optionally includes support devices, communication devices, and computing devices. The tool body 171 houses a formation testing tool 150 that acquires samples from the formation. In an embodiment, the power source 149 is positioned in the tool body 171 to provide power to the formation testing tool 150. The tool body 171 may further include additional testing equipment 172. In operation, a wireline system 170 is typically sent downhole after the completion of a portion of the drilling. More specifically, the drill string 108 creates a borehole 112. The drill string is removed and the wireline system 170 is inserted into the borehole 112.

Figure 2:
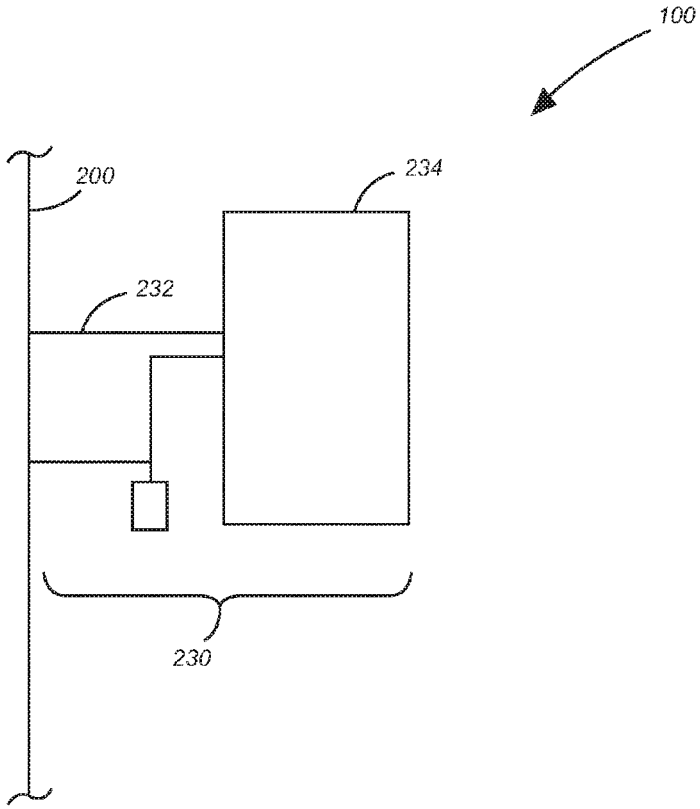
FIG. 2 illustrates a block diagram of a portion of the system as constructed in accordance with at least one embodiment.

Referring to FIG. 2, the system 100 includes a main flow line 200 through which pumping operations occur, and/or fluid sampling occurs. The system further includes a measurement module 230 coupled with the main flow line 200. The measurement module 230 includes an isolation line 232 and an apparatus or method for drawing fluid through the isolation line 232. For example, the measurement module 230 includes at least one isolation pump 234. The at least one isolation pump 234 includes, but is not limited to, a single piston pump, a dual reciprocating pump, or a combination thereof. In another option, the measurement module does not need a piston to draw fluid into the measurement module. For example, the measurement module 230 includes a centrifuge to create flow through the isolation line 232. In another option, a flow is produced through the isolation line 232 using a parallel path, for example, using the flow produced by another pump, such as a pump independent from the measurement module 230. Optionally, isolated measurements are made by bombarding the fluid acoustically, magnetically, using radiation or vibration or other methods to make measurements.

The measurement module 230 is used to manipulate a fluid independent of the flow line 200, for example, to determine the bubble point of the fluid, or other properties. Various methods can be used to measure the bubble point. In an example method, a piston gradually reduces pressure in a chamber where a sample is contained, while the pressure in the chamber is monitored. The pressure is reduced by increasing the volume in the chamber (e.g. cylinder), for example by retracting a piston within the chamber. The pressure of the chamber is monitored, and a bubble point may be determined by analyzing the pressure versus volume relationship.

The measurement module 230 can be used to manipulate a fluid of the flow line 200, without affecting the operation of the flow line 200 while the fluid is manipulated. For example, during pumping operations, fluid can be pumped or sampled via the flow line 200, and the measurement module 230 is used to manipulate the fluid without having to stop operation of the flow line 200, for example. In another example, the measurement module 230 can be used to manipulate the fluid of the flow line 200 without substantially dropping the pressure significantly within the flow line 200.

Figure 4A:
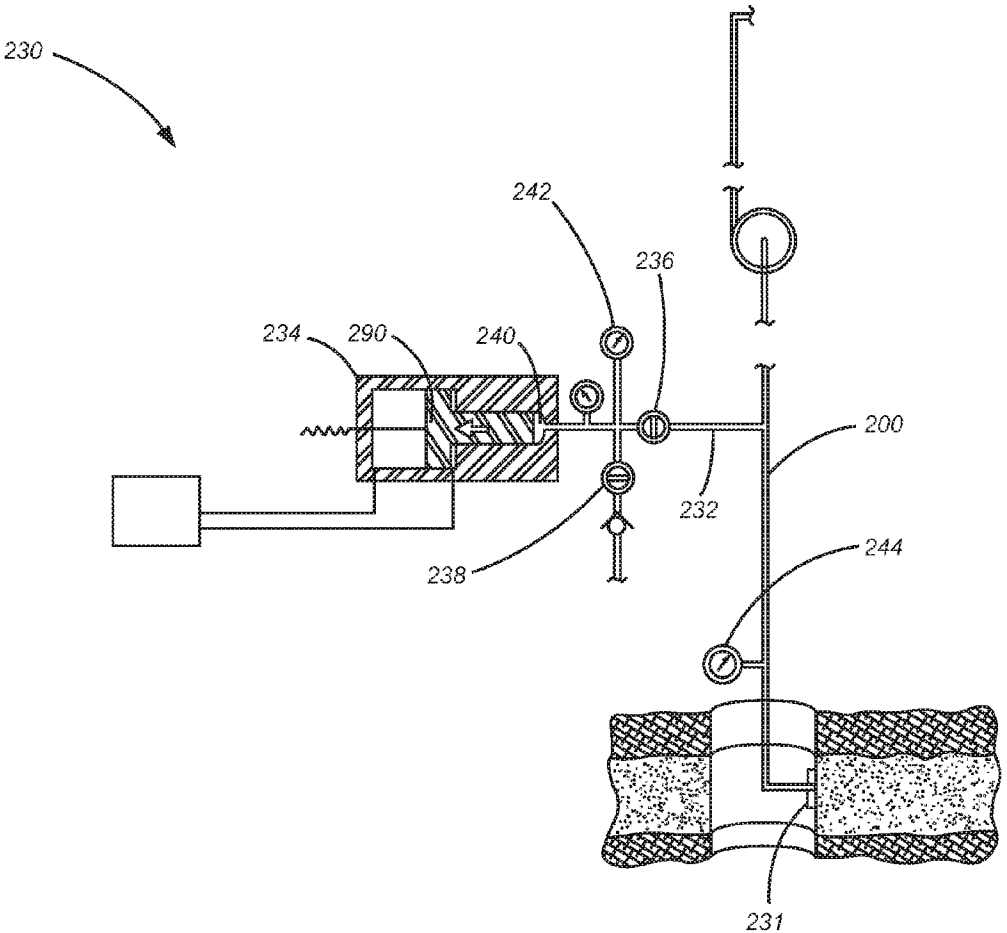
FIG. 4A illustrates a measurement module as constructed in accordance with at least one embodiment.
Figure 5A:
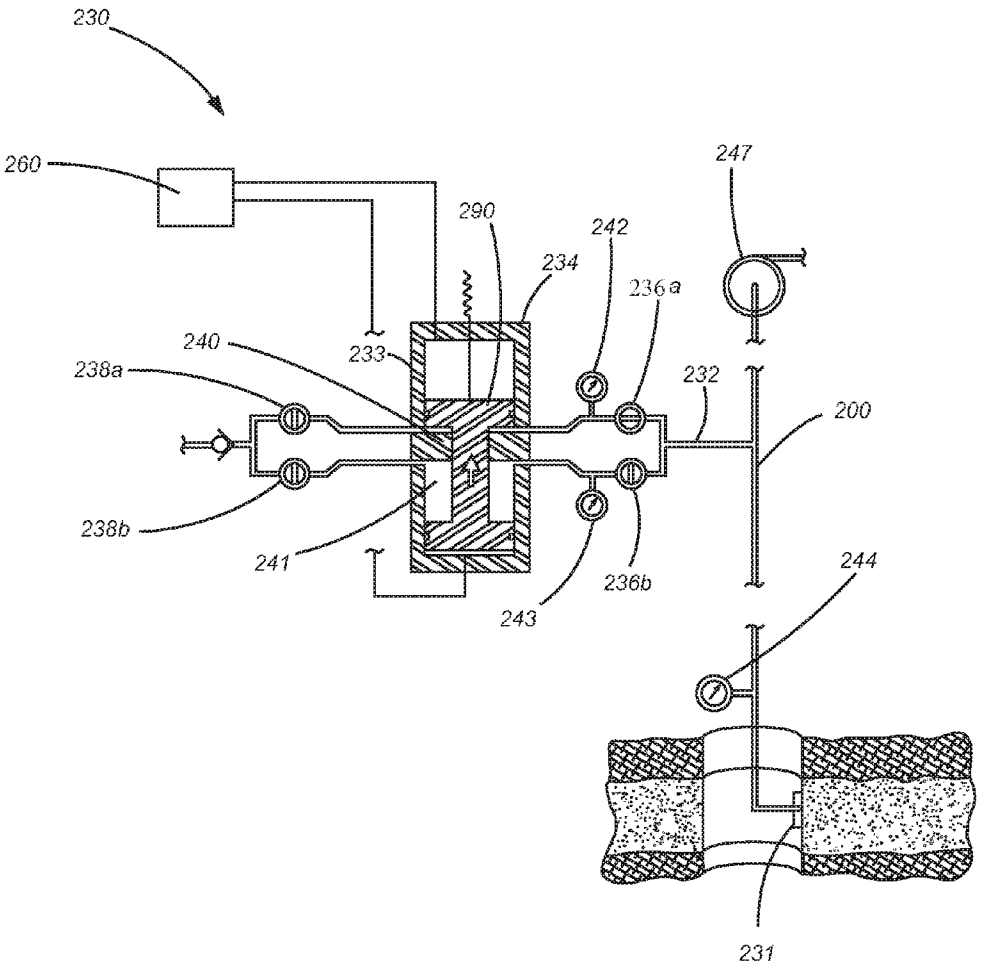
FIG. 5A illustrates a measurement module as constructed in accordance with at least one embodiment.

Referring to FIGS. 2, 4A, and 5A, the pump 234, or other measures for creating flow in the isolation line, is isolated from the flow line 200 and optionally the borehole (FIG. 1) via, for example, one or more devices that can cease or otherwise restrict flow to the isolation line, for example, isolation valves 236. It should be noted that other devices other than valves can be used and are contemplated herein, such as, but not limited to, flow blockers, flow restrictors, etc., or any method to control movement of fluid. When the one or more isolation valves 236, or other devices, are opened, fluid can be drawn from the flow line 200 and into a chamber of the measurement module 230. Once the chamber has sufficient sample fluid for manipulation, for example, sufficient to perform a bubble point measurement, the one or more isolation valves 236, or other devices, can be closed allowing the fluid to be manipulated, for example to obtain a bubble point. The measurement module 230 further optionally includes one or more exhaust isolation valves 238 that can be opened and the used sample fluid is expelled into the borehole, and optionally may be expelled through a check valve. In a further option, valve 238 is a check valve, or includes other structure to limit the flow of fluid in one direction. It should be noted that other devices can be used in place of valves 238 or in combination with valves 238, such as, but not limited to flow blockers, flow restrictors, etc. The pressure before, between, or after the valves 236, 238 is optionally equalized before they are open for one or both of the inlet and exhaust processes.

Figure 3:
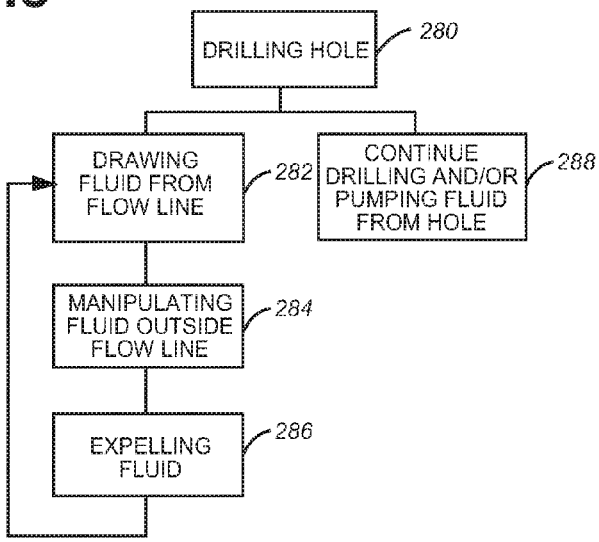
FIG. 3 illustrates a flow chart in accordance with at least one embodiment.

FIG. 3 illustrates a flow chart of the process for manipulating the fluid. At 280, the borehole is drilled as further discussed above. At 288, drilling continues to occur, where the drilling includes, but is not limited to, down hole sampling. Alternatively, or in combination with drilling and/or sampling, at 288 pumping operations are occurring via the flowline. The pumping operation is taking place in attempt to purge the "packed-off" formation of interest (at pad 231) of drilling fluid filtrate in order to access true, uncontaminated formation fluids. Once the pumping has achieved a steady state flowing condition from the formation, it is detrimental or counterproductive to halt the pumping to obtain fluid property measurements.

At 282, fluid is drawn from the flow line, for example, but not limited to, with a pump. Various examples of ways of drawing flow from the flow line, such as with pumps are discussed above and below. For instance, pumps with a single chamber or pumps with multiple chambers can be used. Alternatively, or in combination with pumps, other methods for producing flow can be used. Notably, drawing fluid from the flow line, although is not mandatory, can occur without stopping other processes, such as the pumping process. Drawing the fluid from the flow line does not substantially affect the flow line, such that it can be done when the flow line is being used for another process, such as, but not limited to, pumping. At 284, the fluid is manipulated outside of the flow line. For example, a bubble point measurement is taken, as further discussed below. At 286, the fluid is expelled, for example, into the borehole.

The method allows for the ability to extract a portion of the pumped fluid from the flowline in order to make relatively continuous measurements regarding the quality of the flowline fluids without having to stop the primary pumping operation. The process can be repeated, as shown in FIG. 3. The method allows for the bubble point to be measured frequently, such as every 1 to 5 minutes.

Figure 4B:
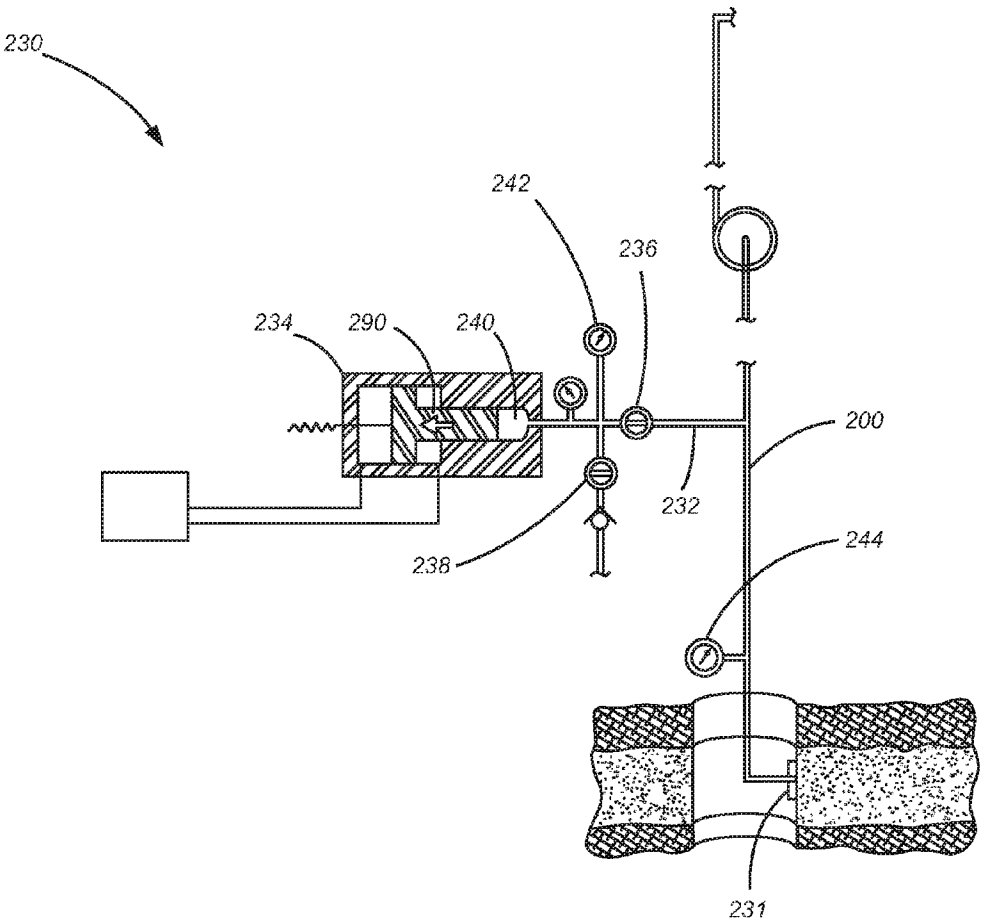
FIG. 4B illustrates a measurement module as constructed in accordance with at least one embodiment.
Figure 4C:
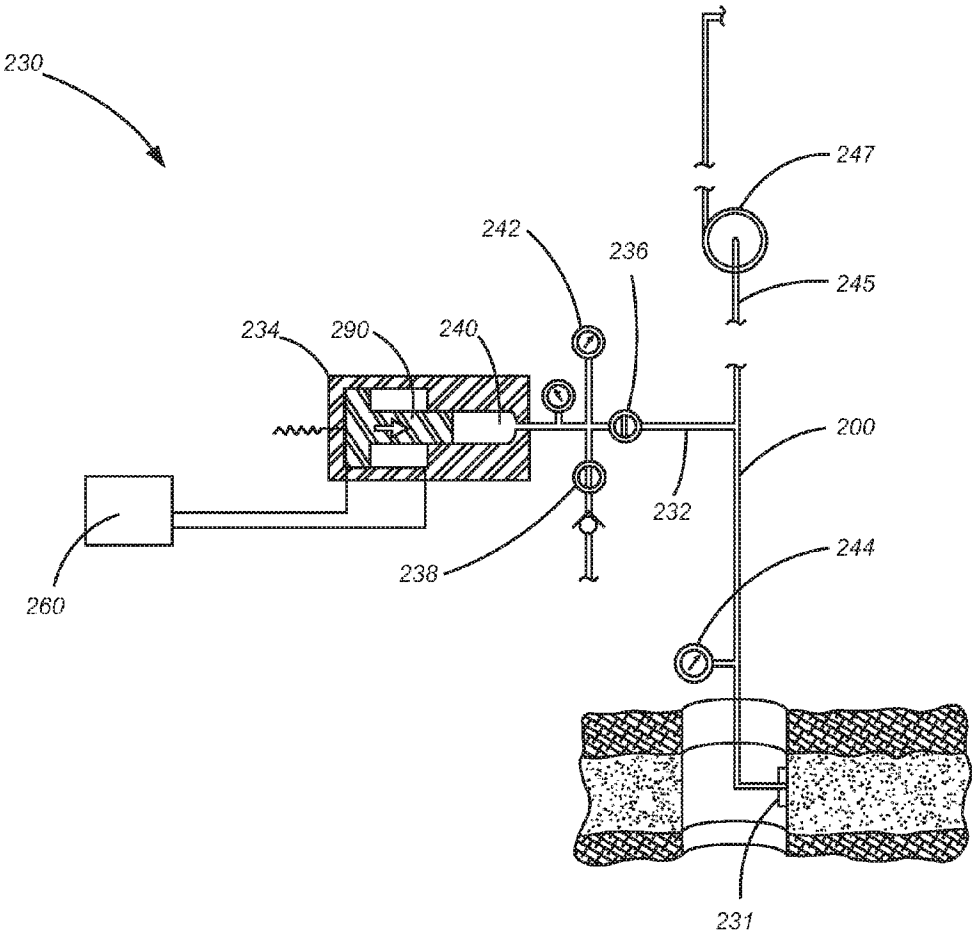
FIG. 4C illustrates a measurement module as constructed in accordance with at least one embodiment.

FIGS. 4A-4C illustrate an example use of an example embodiment. FIG. 4A illustrates a measurement module 230 with a pump 234 such as a single piston pump, and further including an isolation valve 236 and an exhaust isolation valve 238. The piston 290 of the pump 234 is moved to equalize the pressure across the isolation valve 236. This pressure equalization is indicated by the measurements of the test chamber pressure transducer 242 and the flowline pressure transducer 244. The valve 236 is placed in the open position allowing for the chamber 240 to intake fluid from the flowline (FIG. 4B) via pad 231 and the isolation line 232. The sample fluid is drawn into the chamber 240 at a rate so as to not substantially drop the pressure of the flowline (FIG. 4B). In an example, the flowline pressure is not dropped more than 1-4 psi. In another example, the flowline pressure is not dropped below the bubble point. In yet another example, the fluid is drawn at a rate of about 0.1 cc/sec, for example, to ensure the pressure is not dropped in heavy oil or low permeability rocks.

When sufficient fluid sample has been acquired to perform a desired measurement or fluid manipulation, the valve 236 can be closed. In an example, the piston 290 is moved to increase the volume in the chamber, and the trapped fluid will be gradually reduced in pressure by the increase in volume. A gauge optionally monitors one or more conditions of the fluid, for example the pressure and the gradient of the fluid, and a determination of the bubble point will be detected. Optionally, the measurement module 230 further may include a relief valve from the isolation line to ensure the reduction of pressure is not too great during the decompression phase after the bubble point is detected. Optionally the pressure is equalized again using the piston 290. Referring to FIG. 4C, the exhaust isolation valve 238 is opened and the manipulated sample fluid is expelled from the chamber 240 and into the borehole, or collected, or move to another measurement process. Additional measurements and/or manipulations include, but are not limited to, pressure, acoustic, radiation, light, heat and vibration. If desired, the manipulated fluid may be expelled back into flowline 200 via isolation line 232 by re-opening isolation valve 236 and moving piston 290 in the closed direction. If this method is utilized, the pressure across isolation valve 236 is equalized prior to opening.

Figure 4D:
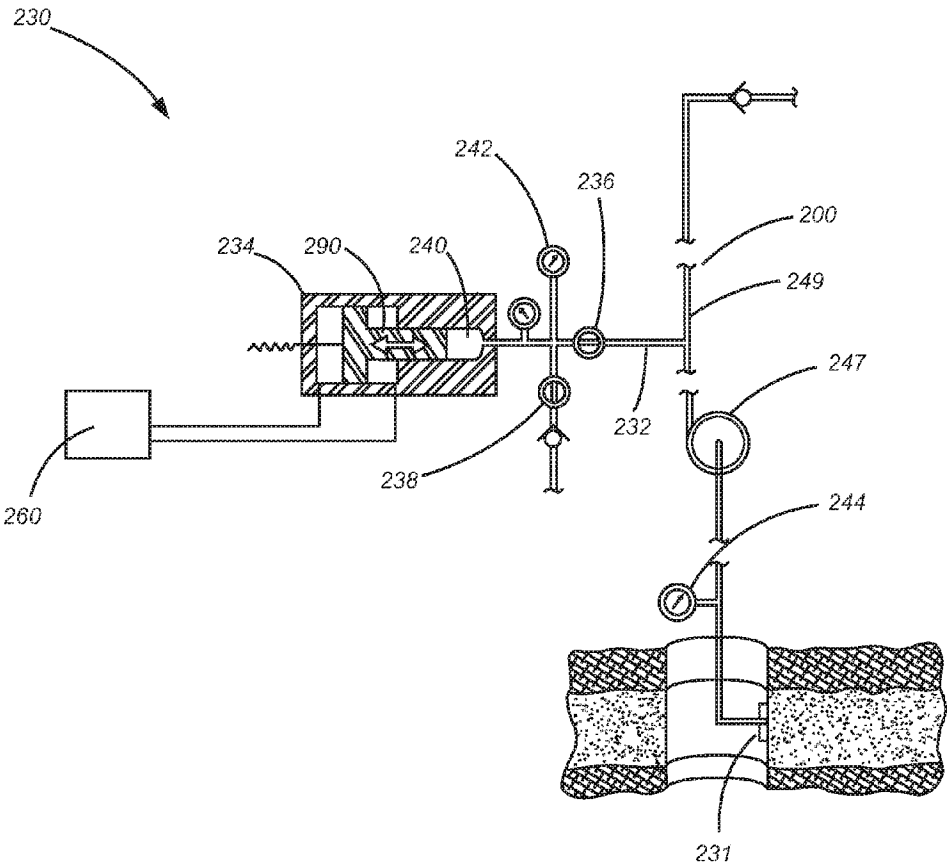
FIG. 4D illustrates a measurement module as constructed in accordance with at least one embodiment.

It should be noted in FIGS. 4A-4C that isolation line 232 is connected to flowline 200 between the fluid point of entry and the inlet to the downhole pump. The pressure within the isolation line 232 is the "flowing" pressure from the "packed-off" formation of interest within flowline 200. With the isolation line 232 connected to flowline 200 at the inlet side 245 of the pump 247, pressure equalization across isolation valve 236 prevents disruptive pressure spikes (either positive or negative) from propagating through flowline 200 to the "packed-off" formation of interest at pad 231. FIG. 4D shows an alternate configuration which eases the equalization requirement across isolation valve 236. In this configuration, the isolation line 232 is connected to the flowline 200 at the outlet side 249 of the pump 247. The pressure in flowline 200 at the outlet side 249 of the pump 247 is typically at the hydrostatic pressure of the wellbore (outside of the packed-off formation) and therefore, pressure fluctuations as a result of operation of isolation valve 236 are not as disruptive.

FIGS. 5A-5D illustrate another example of a measurement module 230 in which a dual reciprocating pump 233 is used for the pump 234. The measurement module 230, in an option, includes at least one chamber, such as two chambers 240, 241 performing the same operations out of sequence to double the effectiveness of the sampling process, as shown in FIG. 5A. It should be noted that multiple pumps and/or multiple chambers can be used with the measurement module 230 for further efficient testing of the fluid.

The measurement module 230 further includes a hydraulic closed loop control system, in an option, which is what drives the dual reciprocating pump 233. This can be run in tandem with an existing pump either independently or synchronized. In yet another option, the measurement module 230 includes a hydraulic controller 260. In an option, hydraulic controller 260 controls the dual reciprocating pump 233 at a ratio proportionate to a volume being pumped in the flowline 200 and at a rate required to obtain a bubble point measurement. For example, a ratio of 10:1 when the pump rate ranges from about 0.1 cc/sec to 68 cc/sec, and the chamber would be about 0.01 to 6.8 cc/sec. In another option, the measurement module 230 stroke time is synchronized to another pumping device, such as the main pump (FIG. 1) and at a stroke phase relationship to reduce the effects of fluid draw and/or manipulation, such as bubble point measurement.

The measurement module 230 includes isolation valves 236*a* and 236*b*, such as a high pressure valve, that controls the flow of fluid from the flow line 200 into the chambers 240, 241. It should be noted that devices other than a valve can be used, such as restrictors. The exhaust isolation valves 238*a* and 238*b* control the exhaust of fluids from the measurement module, and into the bore hole, for example. The valves 236*a*, 236*b*, 238*a*, 238*b* are optionally controlled by the hydraulic controller 260 and are monitored, for example, by a potentiometer. In an option, the sequencing of the valve(s) compared to the piston 290 position will be timed to ensure the measurement effectiveness and the stability of the measure fluid and controlled by hydraulic controller 260. The measurement module 230 further includes sensors such as, but not limited to, pressure and/or fluid temperature sensors 242 and 243. The pressure sensors 242 and 243 have, in an option, an adequate tolerance to measure the fluid phase shift to detect a bubble point at the set operating range of the isolation pump. Other options include additional sensors to detect changes in the fluid due to the compression and/or decompression phase of the measurement.

FIG. 5A illustrates the intake phase of chamber 240 and correspondingly, the pressure equalizing phase of chamber 241. The isolation valve 236*a* for the chamber 240 is opened and the exhaust valve 238*a* is closed. Both the isolation valve 236*b* and exhaust valve 238*b* for chamber 241 are closed. The piston 290 travels in the direction of the arrow. As the piston 290 travels in this direction within the pump 233, fluid is drawn from the flow line 200 into chamber 240 at a rate, for example, set by the hydraulic controller 260. At the same time, the motion of piston 290, which expands volume of chamber 240, serves to contract the volume of chamber 241. This reduction in volume serves to equalize the pressure across exhaust valve 238*b*. The valve sequence will allow fluid to be drawn from the flow line 200 at pumping pressure, and the volume drawn will not cause a significant reduction of flow line pressure, or will not substantially affect flow line pressure. In an example, the flow line pressure is not affected by more than 1 psi. In another example, the ratio of volumetric flowrate in the flow line to the isolation line is 10:1. In another option, the ratio is in the range of about 20:1. The valve 236*a* is opened at the start of the stroke of the piston 290, and is closed at approximately halfway through the upward stroke of piston 290 (see FIG. 5B). At approximately the same time, exhaust valve 238*b* of chamber 241 is opened. Continued controlled travel of piston 290 expands the sealed off volume of chamber 240 thereby reducing the pressure of the contained fluid sample. By monitoring the pressure of the contained sample, by means of pressure transducer 242, with respect to the change in volume of chamber 240, the bubble point of the sample may be measured. At the same time, this motion of the piston 290 also expels the previously manipulated sample contained in chamber 241 through the open exhaust valve 238*b*.

Figure 5B:
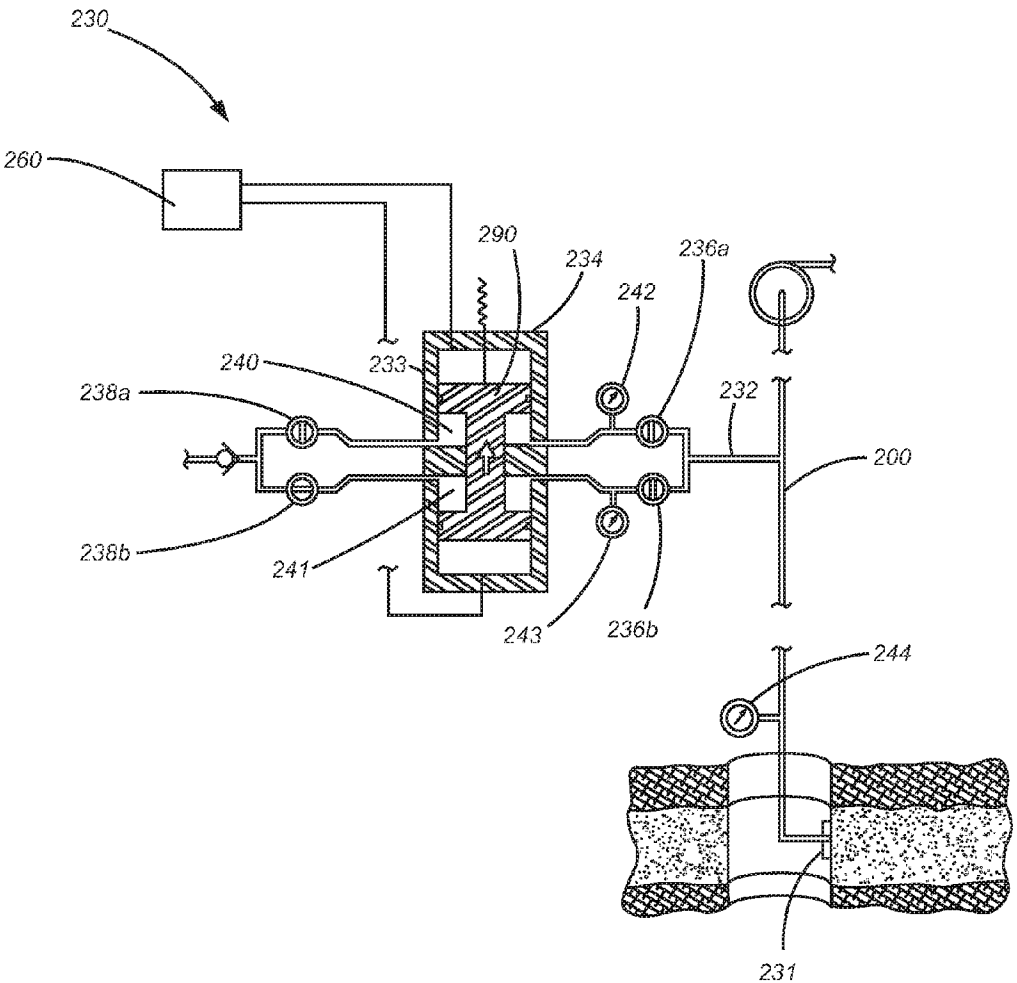
FIG. 5B illustrates a measurement module as constructed in accordance with at least one embodiment.
Figure 5C:
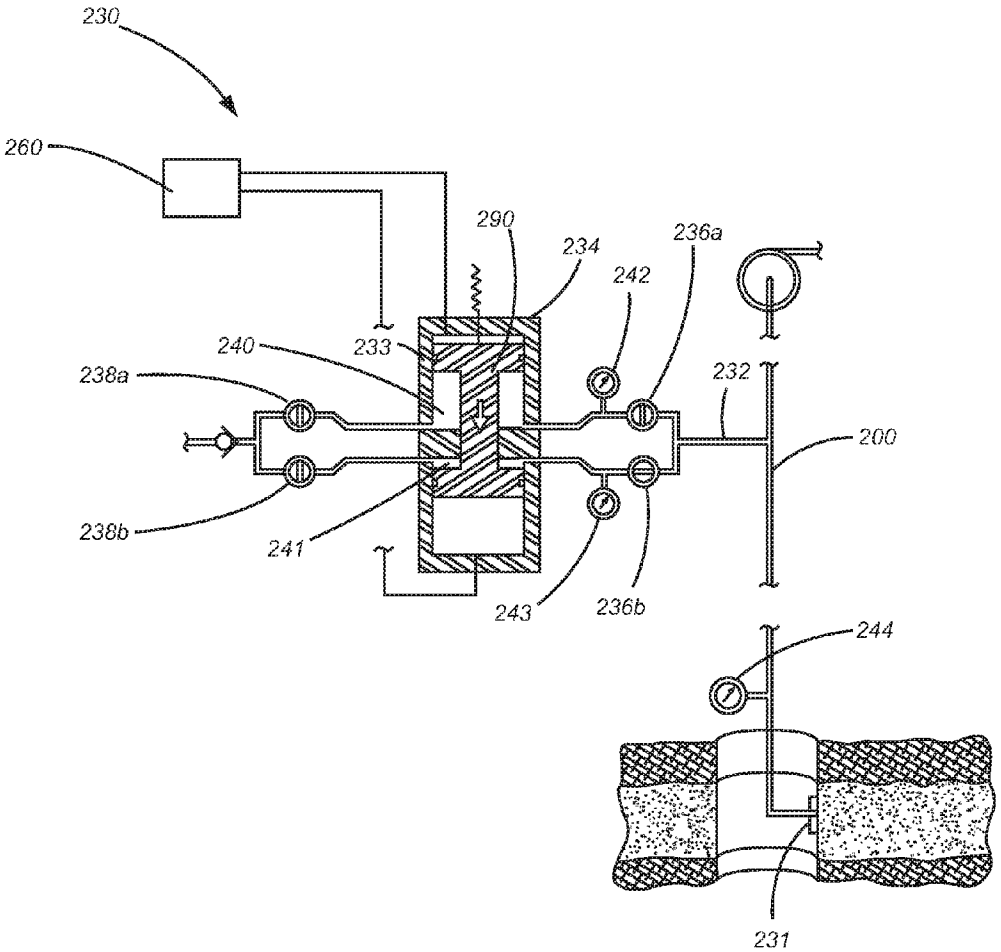
FIG. 5C illustrates a measurement module as constructed in accordance with at least one embodiment.
Figure 5D:
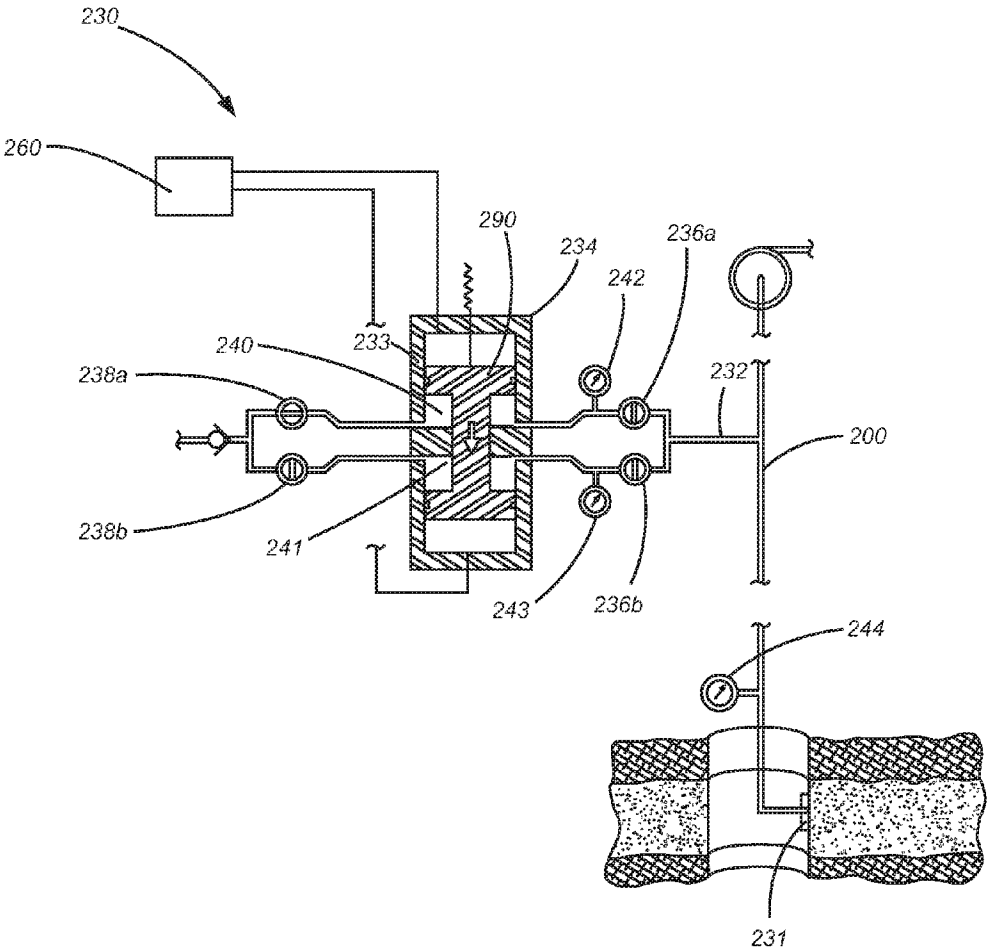
FIG. 5D illustrates a measurement module as constructed in accordance with at least one embodiment.

Referring to FIG. 5C, the piston 290 is traveling in the opposite direction of FIG. 5A and FIG. 5B, where the piston 290 is traveling in the direction of the arrow shown in FIG. 5C. The isolation valve 236*a* and exhaust valve 238*a* of chamber 240 is closed. At approximately the same time, isolation valve 236*b* of chamber 241 is opened. The motion of piston 290 in the direction of the arrow on FIG. 5C reduces the volume of the previously expanded sample contained in chamber 240 and acts to equalize the pressure across the exhaust valve 238*a*. At the same time, the motion of piston 290 will expand the volume of chamber 241 and draw a volume of sample fluid from flowline 200 through the open isolation valve 236*b*. At approximately halfway through the stroke of piston 290, exhaust valve 238*a* of chamber 240 will open and isolation valve 236*b* of chamber 241 will close (see FIG. 5D). Continued motion of piston 290 will expel the previously manipulated sample in chamber 240 through the open exhaust valve 238*b* and at the same time, expand the collected sample in chamber 241. As before, by monitoring the pressure of the contained sample in chamber 241, by means of pressure transducer 243, with respect to the change in volume of chamber 241, the bubble point of the sample may be measured.

The reciprocating piston-style chamber arrangement allows for two separate test chambers to be performing bubble point tests out of phase from one another (i.e. while chamber 240 is expanding the sample to determine the bubble point pressure, chamber 241 is expelling a previously tested sample).

The piston 290 travels within the pump, and the chambers 240, 241, and each of the chambers undergoes a change in activity, as described as follows.

1) sample intake—the test chamber is filled from the flowline at a controlled rate;
2) (Optional Step) sample compression—the sample is compressed until the sample pressure is at a predetermined value equal to or above hydrostatic pressure;
3) sample expansion—the contained sample volume is expanded at a controlled rate; resulting sample pressure versus volume change recorded, i.e. bubble point measurement;
4) sample pressure equalization—the pressure inside the test chamber is equalized to the exhaust line pressure;
5) expel sample—sample is expelled through the exhaust valve to the wellbore or to additional sensors at a controlled rate.

The following table illustrates the "out of phase" bubble point testing sequences of the reciprocating piston, dual chamber test arrangement. The reciprocating piston position is approximate, or in the alternative exact.

| Approx. | Chamber 240 | | | | Chamber 241 | | | |
|---|---|---|---|---|---|---|---|---|
| Piston Position (% of Stroke) | Step | Activity | Isolation Valve Position | Exhaust Valve Position | Step | Activity | Isolation Valve Position | Exhaust Valve Position |
| 0 → 50% | 1 | Intake | Open | Close | 4a | Equalize | Close | Close |
| 50 → 45% | 2 | Compress | Close | Close | 4b | | Close | Close |
| 45 →100% | 3 | Expand | Close | Close | 5 | Expel | Close | Open |
| 100 →50% | 4a | Equalize | Close | Close | 1 | Intake | Open | Close |
| 50 → 55% | 4b | | Close | Close | 2 | Compress | Close | Close |
| 55 → 0% | 5 | Expel | Close | Open | 3 | Expand | Close | Close |
| 0 → 50% | 1 | Intake | Open | Close | 4a | Equalize | Close | Close |
| 50 → 45% | 2 | Compress | Close | Close | 4b | | Close | Close |
| 45 → 100% | 3 | Expand | Close | Close | 5 | Expel | Close | Open |
| 100 → 50% | 4a | Equalize | Close | Close | 1 | Intake | Open | Close |
| 50 → 55% | 4b | | Close | Close | 2 | Compress | Close | Close |
| 55 → 0% | 5 | Expel | Close | Open | 3 | Expand | Close | Close |
| 0 → 50% | 1 | Intake | Open | Close | 4a | Equalize | Close | Close |
| 50 → 45% | 2 | Compress | Close | Close | 4b | | Close | Close |
| 45 → 100% | 3 | Expand | Close | Close | 5 | Expel | Close | Open |

If desired, the manipulated fluid may be expelled back into flowline 200 via isolation line 232 by re-opening isolation valve 236*a* or 236*b* and moving piston 290 in the direction to minimize the volume of either chamber 240 or 241. If this method is utilized, the pressure across isolation valve 236*a* or 236*b* is equalized prior to opening.

Figure 5E:
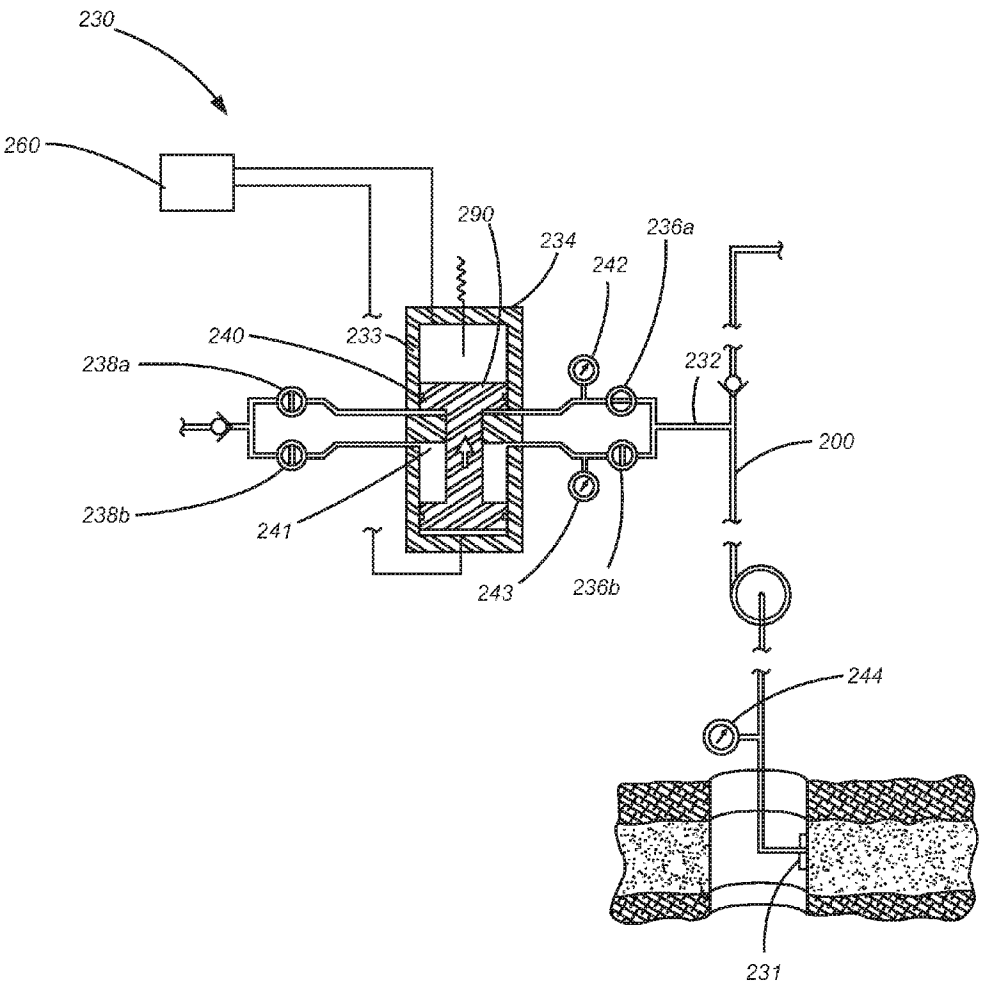
FIG. 5E illustrates a measurement module as constructed in accordance with at least one embodiment.

It should be noted in FIGS. 5A-5D that isolation line 232 is connected to flowline 200 between the fluid point of entry at pad 231 and the inlet to the downhole pump. The pressure within the isolation line 232 is the "flowing" pressure from the "packed-off" formation of interest within flowline 200. With the isolation line 232 connected to flowline 200 at the inlet side of the pump, pressure equalization across isolation valves 236*a* and 236*b* prevents disruptive pressure spikes (either positive or negative) from propagating through flowline 200 to the "packed-off" formation of interest at packer 231. FIG. 5E shows an alternate configuration which eases the equalization requirement across isolation valves 236*a* and 236*b*. In this configuration, the isolation line 232 is connected to the flowline 200 at the outlet side of the pump. The pressure in flowline 200 at the outlet side of the pump is typically at the hydrostatic pressure of the wellbore (outside of the packed-off formation) and therefore, pressure fluctuations as a result of operation of isolation valves 236*a* and 236*b* are not as disruptive.

Advantageously, the bubble point of the fluid being pumped and/or tested can be determined without affecting the pumping operations, or the drilling operations, or without having to cease the pumping or drilling operations, or without having to drop the flowline pressure below the bubble point in the sample flowline. This can increase the efficiency of the pumping or drilling operations. Furthermore, the bubble point can be obtained without the need to re-inject manipulated fluid or gas into the flow line. Samples can be obtained with low levels of contamination.

Reference in the specification to "an option," "an embodiment," "one embodiment," "some embodiments," or "other embodiments" means that a particular feature, structure, or characteristic described in connection with the options or embodiments is included in at least some embodiments, but not necessarily all embodiments, of the invention. The various appearances of "an embodiment," "one embodiment," or "some embodiments" are not necessarily all referring to the same embodiments.

Although specific embodiments have been described and illustrated herein, it will be appreciated by those skilled in the art, having the benefit of the present disclosure, that any arrangement which is intended to achieve the same purpose may be substituted for a specific embodiment shown. This application is intended to cover any adaptations or variations of the present invention. Therefore, it is intended that this invention be limited only by the claims and the equivalents thereof.

What is claimed is:

1. A method comprising:

pumping fluid in a borehole through a flow line with a down hole apparatus, the down hole apparatus including a down hole apparatus pump;

drawing fluid from the flow line through an isolation line without substantially dropping pressure of the flow line, where fluid is pumped through the flow line while fluid is drawn from the flow line;

manipulating the fluid drawn from the flow line; and expelling the manipulated fluid.

2. The method as recited in claim 1, wherein manipulating the fluid includes obtaining a bubble point of the fluid.

3. The method as recited in claim 1, wherein manipulating the fluid includes testing the fluid.

4. The method as recited in claim 3, wherein testing the fluid includes testing at least one of pressure or temperature of the fluid.

5. The method as recited in claim 1, wherein expelling the manipulated fluid includes expelling the manipulated fluid into at least one of the bore hole, or a chamber, or a vessel.

6. The method as recited in claim 1, wherein drawing fluid from the flow line includes drawing the fluid with at least one of a reciprocating pump, a single piston pump, a dual reciprocating pump, or a receiving vessel.

7. The method as recited in claim 1, wherein drawing fluid from the flow line through an isolation line includes drawing fluid through a first isolation line, and drawing fluid through a second isolation line out of sequence from the first isolation line.

8. The method as recited in claim 1, further comprising opening one or more valves before drawing fluid from the flow line.

9. The method as recited in claim 8, further comprising equalizing pressure across the one or more valves before opening the one or more valves.

10. The method as recited in claim 1, wherein drawing fluid through the isolation line includes drawing fluid with an isolation line pump, and synchronizing the isolation line pump with the downhole apparatus pump.

11. An apparatus comprising:

a down hole apparatus including a flow line pump and a bore hole flow line, the bore hole flow line operatable at a bore hole flow line pressure;

the flow line pump coupled with the bore hole flow line; and means for drawing sample fluid from the bore hole flow line into at least one chamber via at least one isolation line while fluid is pumped through the flow line without substantially dropping pressure in the bore hole flow line.

12. The apparatus as recited in claim 11, wherein the means for drawing sample fluid includes a means for measuring bubble point of the fluid while operating the flow line pump.

13. The apparatus as recited in claim 11, wherein the means for drawing sample fluid further includes at least one or more of a temperature sensor or a pressure sensor.

14. The apparatus as recited in claim 11, wherein the means for drawing sample fluid includes a pump synchronized with the flow line pump.

15. The apparatus as recited in claim 11, wherein the means for drawing sample fluid includes at least one or more of a single piston pump or a dual reciprocating pump.

16. An apparatus comprising:

a down hole apparatus including a flow line pump and a bore hole flow line, the bore hole flow line operatable at a bore hole flow line pressure;

the flow line pump coupled with the bore hole flow line;

a measurement module including at least one isolation line coupled to at least one isolation pump, the at least one isolation line communicatively coupled with the bore hole flow line; and the at least one isolation line operatable in tandem with the down hole apparatus without substantially affecting the bore hole flow line pressure.

17. The apparatus as recited in claim 16, further comprising at least one or a pressure sensor or a temperature sensor associated with the at least one isolation line.

18. The apparatus as recited in claim 16, wherein the measurement module determines a bubble point of drawn fluid in the measurement module while the flow line pumps fluid through the bore hole flow line.

19. The apparatus as recited in claim 16, wherein the isolation pump is synchronized with the flow line pump.

20. The apparatus as recited in claim 16, further comprising two or more isolation pumps, and at least two of the two or more isolation pumps are operatable out of sequence with each other.

21. The apparatus as recited in claim 16, wherein the at least one isolation pump is at least one of a single piston pump or a dual reciprocating pump.

* * * * *